United States Patent [19]

Meador

[11] Patent Number: 4,605,268

[45] Date of Patent: Aug. 12, 1986

[54] TRANSFORMER CABLE CONNECTOR

[75] Inventor: Richard A. Meador, Spring, Tex.

[73] Assignee: NL Industries, Inc., New York, N.Y.

[21] Appl. No.: 439,797

[22] Filed: Nov. 8, 1982

[51] Int. Cl.[4] ..... H01R 15/30

[52] U.S. Cl. ..... 339/16 C; 340/854

[58] Field of Search ..... 339/16 R, 16 C, 15, 339/16 RC, 84 C, 90; 340/853, 854, 856, 855, 858

[56] References Cited

U.S. PATENT DOCUMENTS

| | | | |
|---|---|---|---|
| 2,301,783 | 11/1942 | Lee | 339/16 R |
| 2,379,800 | 7/1945 | Hare | 340/854 X |
| 2,414,719 | 1/1947 | Cloud | 340/854 X |
| 3,079,549 | 2/1963 | Martin | 340/853 X |
| 3,090,031 | 5/1963 | Loro | 340/854 |
| 3,186,222 | 6/1965 | Martin | 340/854 X |
| 3,227,973 | 1/1966 | Gray | 336/90 X |
| 3,879,097 | 4/1975 | Oertle | 339/16 R |
| 4,348,672 | 9/1982 | Givler | 340/854 |

*Primary Examiner*—William R. Briggs

*Attorney, Agent, or Firm*—Browning, Bushman, Zamecki & Anderson

[57] ABSTRACT

Connectors for electrically coupling conductors wherein the connection is effected by current coupling are disclosed. Each connector includes a toroidal coil and a housing member. The connection is accomplished by aligning the toroidal coils generally parallel and closing the housing members to provide a generally toroidal conductive path enclosing the paired coils. Cable segments extending along tubular members may end in electrical connectors at both ends of the tubular members so that a pipe string may be assembled to include a sequence of cable segments interconnected by current coupling transformers.

24 Claims, 13 Drawing Figures

FIG. 7
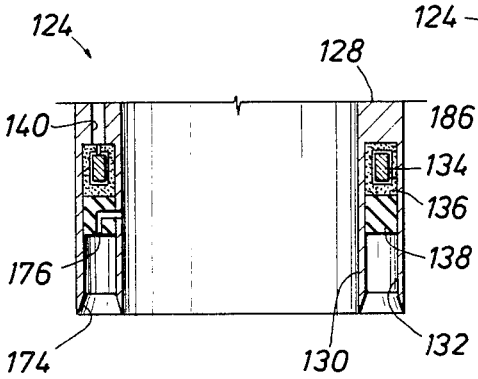
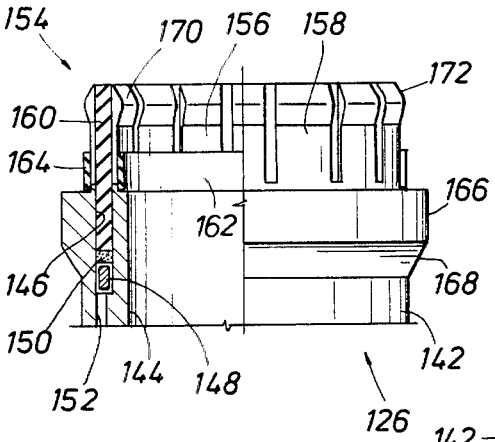
FIG. 8
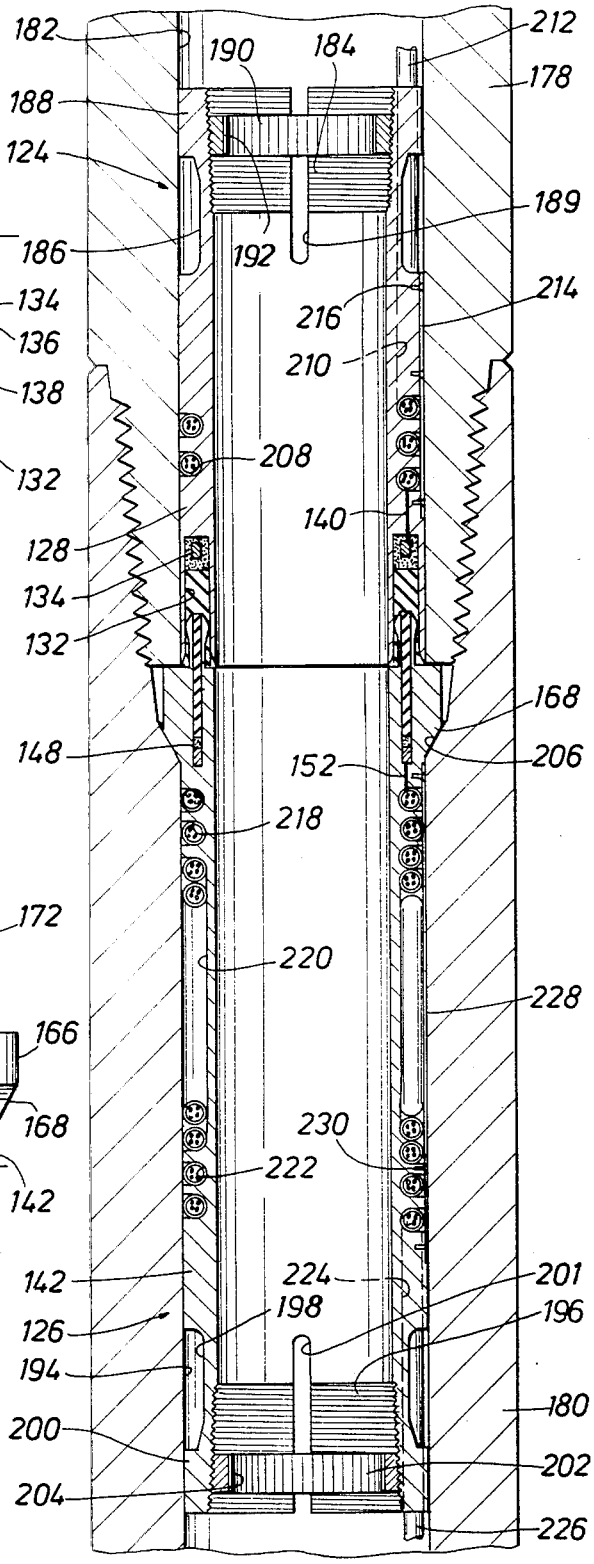
FIG. 9

TRANSFORMER CABLE CONNECTOR

BACKGROUND OF THE INVENTION

1. Field of the Invention

The present invention pertains to techniques for establishing electrical connections. More particularly, the present invention relates to apparatus and methods for coupling conductors carrying electronic signals, and finds particular application in the connection of cable segments mounted in pipe members wherein the individual cable segments are coupled at the pipe joints.

2. Description of the Background

In the practice of drilling wells and in other well working operations various procedures involve the transmission of information from within the well to instrumentation at the surface to convey data reflecting downhole conditions. Such cases include measurement while drilling procedures wherein underground formation characteristics are logged while the well is being drilled. Electronic signals are also transmitted from the surface to downhole apparatus to initiate logging procedures or explosives, for example.

Various methods have been employed or suggested for communicating electronic and other signals between downhole locations and the surface. Mud pulsing may be utilized to transmit data to the surface by means of pressure surges generated in the drilling mud within a drill string by operation of a downhole valve according to the data gathered and to be transmitted. Electromagnetic wave propogation may also be utilized to transmit data to the surface. Such wave techniques are generally limited to the rates at which data bits may be transmitted.

Techniques for providing electrical conductors in pipe strings are known. Such techniques include incorporating conductors within the individual pipe members, or mounting cable segments within the pipe members. The individual cable segments are interconnected at the pipe joints of a pipe string. Ohmic contacts between the cable segments, or jumper cables, may be utilized to connect the cable segments into a continuous transmission path. Cables and other conductors provided in conjunction with a pipe string may be utilized to transmit signals from the surface to control various downhole functions in addition to transmitting information to the surface from below.

While cable and other tubing-carried conductors permit relatively high rates of data transmission between the surface and downhole locations, drill pipe especially modified to accomodate or include such conductors is generally expensive, and may interfere with normal drilling operations. Special joint greases are also required to reduce electrical leakage, further interfering with rig floor operations.

SUMMARY OF THE INVENTION

The present invention provides a method and apparatus for connecting electrical conductors, e.g. across pipe joints in conjunction with standard pipe members, using current coupled transformers.

An electrical connection between conductors, established in accordance with the present invention, comprises first and second toroidal coils, with each coil connected to a corresponding conductor segment. First and second generally toroidal housing members of electrically conducting material partially confine the first and second coils, respectively. When the first and second coils are positioned generally mutually parallel, the first and second housing members cooperate to enclose the coils and provide a generally toroidal conducting path encompassing both coils. The two coils and the housing thus formed are mutually isolated, or insulated. Generation of a varying electrical signal in one coil ultimately produces a like varying electrical signal in the other coil, with the coupling between coils provided by the enclosing conductive housing. The varying electromagnetic field associated with the primary coil induces varying electric current about the toroidal housing, with the current flowing generally in loop fashion linking the primary coil. At the same time, the induced housing current links the second coil, and provides an electromagnetic field, varying as that produced by the primary coil signal, to induce a corresponding signal in the secondary coil.

The coils and the housing members are appropriately insulated to avoid shorting contact, and may further include means for mechanically connecting the housing members when the electrical connection between the cable segments is effected.

The housing members may include, for example, a receptacle carried by one housing member, and a complementary plug carried by the other housing member joined with the first housing member in effecting the electrical connection. Such a plug may, for example, include a spring facility to cooperate with the receptacle to latch the housing members together.

Connectors of the present inventon may be positioned at the ends of tubular members so that, as the tubular members are mechanically joined, as by threaded engagement therebetween, the first and second toroidal coils may appropriately align and the housing members mutually close to provide a pair of generally parallel coils positioned within a generally closed toroidal conductor at the pipe joint. The closing of the current coupled electrical connector may be effected automatically as the tubular members are mechanically joined. The mechanical latching of the electrical connector may be releasable whereby the electrical connection may be automatically broken when the tubular members are mutually separated.

A tubular member may include an elongate conductor or conductor assembly, such as provided by a cable, positioned within the longitudinal passage of the member, and ending in a connector member according to the present invention at one or both ends of the tubular member. The toroidal coils of the connectors of the present invention may, for example, be incorporated in the ends of a tubular member, such as within a collar. Then, the condctor may enter the collar at a point just before the end of the tubular member. As complementary ends of two tubular members with collar-mounted electrical connectors are threaded together, the connector coils are automatically aligned and enclosed in the connector housing.

The electrical connectors may be provided as separate terminals, mounted within corresponding ends of tubular members with the associated cable segments extended along the interiors of such tubular members. Each electrical connector is self-contained, and may be appropriately anchored within the internal passage of the tubular member. The anchoring of the electrical connector members within the tubular members may be by any appropriate means, such as friction fit. An appropriate installation tool may be utilized to facilitate the mounting of the electrical connectors at the two ends of a tubular member, with the intervening electrical cable extended generally without slack along the interior passage of the tubular member.

A pipe string of cable-equipped tubular members may be assembled, with the electrical connections effected automatically between adjacent pipe members according to the present invention. The end members of such a pipe string may, for example, include but one such electrical connector with the opposite end of the corresponding cable segment within the tubular member connecting to various apparatus, either at the surface of for insertion within a well, for example.

The present invention provides current coupling electrical connectors for use in tubing strings, for example, wherein standard tubing may be utilized. Further, the electrical connections between cable segments of adjacent tubing members may be opened and closed automatically upon the threading and unthreading, respectively, of the tubular members. No special joint greases are required to inhibit electrical leakage since the coils of a closed connector according to the the present invention are encompassed by the conductive housing. Additionally, the data transmission rate limitations of mud pulsing and electromagnetic wave propogation techniques are not characteristic of the cable and current-coupled transformer connections of the present invention.

BRIEF DESCRIPTION OF THE DRAWINGS

Other features and intended advantages of the invention will be more readily apparent by the references to the following detailed description in connection with the accompanying drawings wherein:

FIG. 7 is an elevation in cross section of the female portion of another version of a transformer cable connector.

FIG. 8 is an elevation in cross section of the male portion of the transformer cable connector, complementary to the female connector portion of FIG. 7, and wherein FIGS. 7 and 8 combined provide an exploded view of a cable connection as indicated by the broken lines.

FIG. 9 is an elevation in partial section of a closed transformer cable connection at a pipe joint, including the female and male portions of FIGS. 7 and 8, respectively, and cable anchoring and tensioning components.

While the invention will be described in connection with a preferred embodiment, it will be understood that it is not intended to limit the invention to that embodiment. On the contrary, it is intended to cover all alternatives, modifications and equivalents as may be included within the spirit of the invention as defined in the appended claims.

DESCRIPTION OF PREFERED EMBODIMENTS

Figure 1:
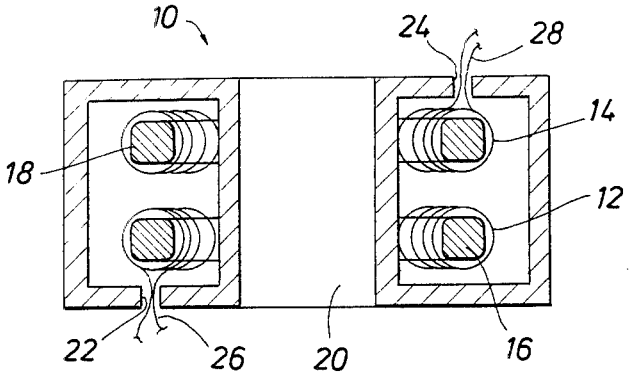
FIG. 1 is an elevation in cross section of a current coupled transformer.
Figure 2:
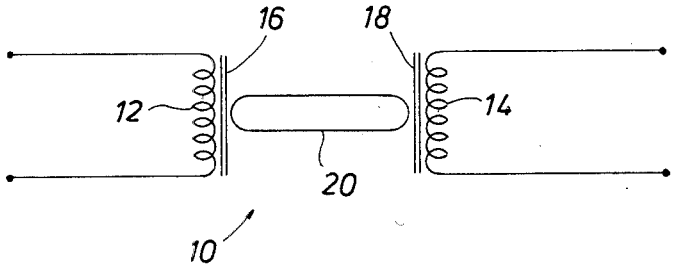
FIG. 2 is a circuit diagram of a current coupled transformer.

A current coupled transformer of the present invention is shown generally at 10 in FIG. 1 and in the circuit diagram of FIG. 2. First and second coils 12 and 14, respectively, are configured around toroidal cores 16 and 18, respectively. The core material is selected for its high magnetic permeability. The coils 12 and 14 are enclosed within a toroidal housing or shell 20 of electrically conducting material, which provides a closed, current-conducting loop for coupling the two core-mounted coils. Appropriate apertures 22 and 24 are provided in the housing 20 so that the ends 26 and 28 of the coils 12 and 14, respectively, may be extended externally of the housing, and continued in appropriate conductors. Such conductors are indicated in FIG. 3, wherein three conductor segments in sequence are shown interconnected by current coupled transformers.

Figure 3:
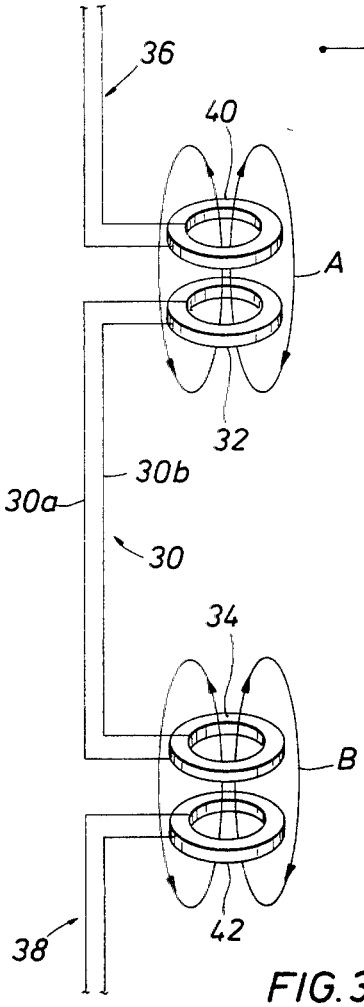
FIG. 3 is a schematic illustrating the interconnection of cable segments, as carried by pipe members, using current coupled transformers.

In FIG. 3 a conductor segment shown generally at 30 includes two conducting elements **30*a* and 30*b* which close at one end of the conductor segment in a toroidal coil 32 and, at the opposite end of the segment, in another toroidal coil 34 to form a closed circuit. The conductor segment 30 is generally elongate, as a cable extended along the interior passage of a pipe member for example. Similar conductor segments shown generally at 36 and 38 are arranged in sequence with the conductor segment 30. The conducting elements of the segment 36 end in a toroidal coil 40 which is axially aligned with, and displaced a short distance from, the coil 32 of conductor segment 30. The conducting elements of the conductor segment 38 close in a toroidal coil 42 which is similarly positioned relative to the coil 34 of the segment 30**.

The paired coils 32 and 40 are linked by current loops indicated by the looped arrows A, flowing about a conducting path linking the coils such as the housing 20 enclosing the coils 12 and 14 in FIG. 1. Such current is generated by the varying electromagnetic field associated with varying electric current applied to one or the other of the coils through its associated conductor segment. An electric current surge in the conductor segment 36, for example, produces an electromagnetic pulse which, in turn, drives an electric current surge, as indicated by the loops A. Since the conductive path along which the current loop flows also encloses the adjacent coil 32, the varying electromagnetic field associated with the current surge A drives a current surge in the second loop 32, thereby transmitting the electric energy from the first conductor segment 36 to the second conductor segment 30. The current thus generated in the second conductor segment 30 produces a varying electromagnetic field about the coil 34 at the opposite end of the segment 30. Current loops B are driven about a conducting path linking the coils 34 and 42. the varying electromagnetic field associated with the current surge B drives a current surge in the next conductor segment 38.

The sequence of conductor segments such as 36, 30 and 38, coupled by paired toroidal coils linked by conductive paths, may be of any length, and inlcude any number of conductor segments.

The conductor segments of FIG. 3 may be cable segments extending along the interior passages of pipe members, with the associated toroidal coils positioned toward the ends of the corresponding pipe members. Each housing 20 may be provided in two parts, so that each toroidal coil is partially enclosed by a portion of a housing, and the remainder of the housing partially confines the toroidal coil at the end of a second pipe member whereby, when the two pipe members are joined, the housing portions combine to provide a closed conductive path linking the paired coils at the pipe joint.

Figure 4:
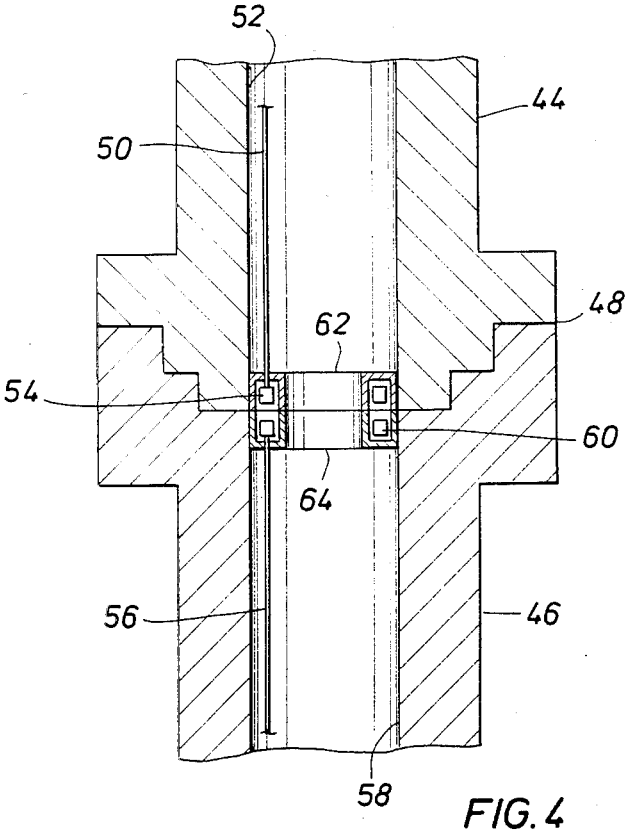
FIG. 4 is a schemactic elevation in cross section of a fragment of two coupled pipe segments, illustrating the location of transformer cable connectors within the pipe central passage.

In FIG. 4 two pipe members 44 and 46 are joined at 48 by any appropriate method, such a threaded connection between complementary ends of the pipe members. A cable segment 50 extends along the interior passage 52 of the first pipe member 44, and ends in a toroidal coil 54 which is axially aligned with the longitudinal axis of the pipe member and the passage. A cable segment 56 extends along the longitudinal passage 58 of the second pipe member 46, and ends in a toroidal coil 60 which is axially aligned with the pipe member and the passage. An annular housing member 62 partially encloses the first toroidal coil 54. A second annular housing member 64 partially encloses the second coil 60. The conducting elements of the cable segments 50 and 56 and of the coils 54 and 60 are insulated or isolated from direct electrical contact with the respective pipe members 44 and 46 and housing members 62 and 64.

The coils 54 and 60 and the housing members 62 and 64 are positioned at the ends of the respective pipe members 44 and 46 so that, as the two pipe members are joined at 48, the paired coils are mutually axially aligned and displaced a short distance, and the housing members contact and combine to provide a toroidal housing enclosing both coils and to establish a toroidal conductive path linking the coils. When the joint 48 is disconnected, the electrical coupling between the cables 50 and 56 is automatically broken as the coils and housing members move apart with the respective pipe members.

Figure 5:
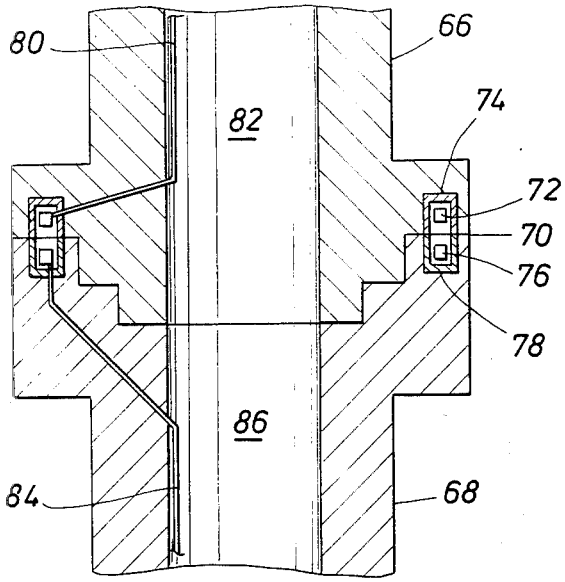
FIG. 5 is a view similar to FIG. 4, but illustrating the location of transformer cable connectors within the walls of the pipe member collars.

Two pipe members 66 and 68 are shown joined at 70 in FIG. 5, as by threading for example. A toroidal coil 72 is partially enclosed by a housing member 74 within the wall of the pipe member 66. A second toroidal coil 76 is partially enclosed by a second housing member 78 within the wall of the pipe member 68. The coils 72 and 76 and housing members 74 and 78 may be incorporated in upset portions of the respective pipe members as illustrated.

A cable segment 80 extends along the interior passage 82 of the pipe member 66, and passes through an appropriate bore in the wall of the pipe member to the coil 72. Similarly, a cable segment 84 extends along the interior passage 86 of the second pipe member 68, and connects to the toroidal coil 76 by means of an appropriate bore in the wall of the pipe member. The conducting elements of the cable segments 80 and 84 as well as the coils 72 and 76 are insulated or isolated from direct electrical contact with the respective pipe members 66 and 68 and housing members 74 and 78.

The coils 72 and 76 and the housing members 74 and 78 are positioned at the ends of the pipe members 66 and 68, respectively, so that, as the pipe members are joined at 70, the coils are automatically aligned mutually parallel and the housing members automatically mutually contact to provide a toroidal conductive path enclosing and linking the two coils. When the pipe members 66 and 68 are disconnected, the electrical coupling between the cables 80 and 84 is automatically broken.

The longitudinal passage through the joined pipe members in each of the arrangements of FIGS. 4 and 5 is not blocked or impeded by the cable segments. The central passage through the combined housing members 62 and 64 of the assembly of FIG. 4 allows a continuous path through the pipe members 44 and 46.

Figure 6:
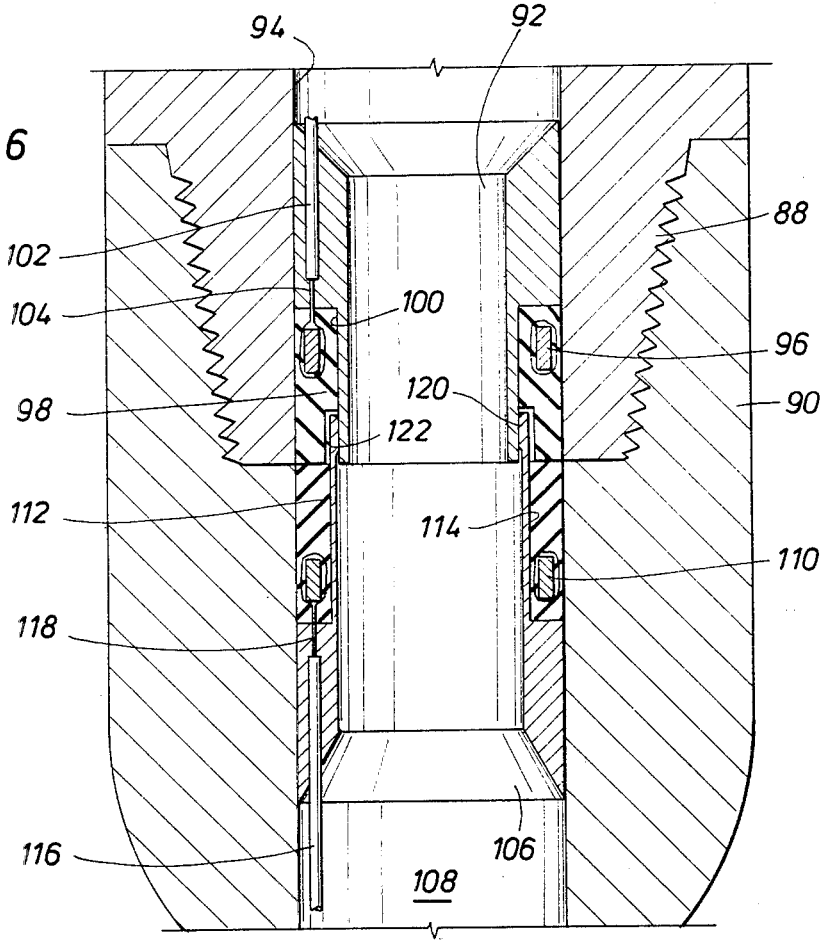
FIG. 6 is a schematic elevation in cross section of a pin and box joint between pipe members employing one version of a transformer cable connection.

In FIG. 6 a current coupled transformer cable connection is shown at a pipe joint including a threaded pin 88 of one pipe member and a threaded box 90 of the second pipe member.

A generally cylindrical insert 92 is positioned within the internal passage 94 of the first tubular member at the pin 88. A core-wound toroidal coil 96 is generally embedded in electrically insulating material 98 confined within an annular inwardly-extending profile 100 of the insert 92 and by the interior surface of the tubular member defining the passage 94. A cable 102 extends along the passage 94 and passes through an appropriate longitudinal bore in the wall of the insert 92. The conducting elements 104 of the cable 102 lead to and continue as the coil 96, and are insulated from the wall of the insert.

The wall of the threaded pin 88 combines with the wall of the insert 92, both of which are of electrically conducting material, to provide a housing member partially enclosing, though insulated from, the toroidal coil 96 which resides in an annular trough defined by the pin-and-insert combination.

A generally cylindrical insert 106 is positioned within the longitudinal passage 108 within the second tubular member at the threaded box 90. The insert 106 includes a core-wound toroidal coil 110 which is generally embedded in electrically insulating material 112 confined within an annular inwardly-extending profile 114 of the insert and by the interior surface of the box wall defining the passage 108. A cable 116 extends along the passage 108 and passes through an appropriate longitudinal bore in the wall of the insert 106, with the conducting elements 118 of the cable continuing as the toroidal coil 110 and being insulated from the wall of the insert.

The wall of the threaded box 90 combines with the wall of the insert 106, both of which are of electrically conducting material, to provide a generally annular housing member partially enclosing, through insulated from, the toroidal coil 110 which resides in an annular trough defined by the box-and-insert combination.

The wall of the second insert 106 extends longitudinally beyond the limit of the adjacent wall of the box 90 as well as the end of the insulating material 112 to establish an annular plug 120. An annular receptacle 122 is provided with the first insert 92 by the end of the conducting wall of the insert cooperating with an appropriate profile in the insulating material 98. As the pin 88 and box 90 are threaded together to provide the joint between the respective pipe members, the plug 120 is received within the receptacle 122. The close fit of the annular plug 120 against the surface of the wall of the insert 92 insures that electrical contact is made between these elements, and may be enhanced by the resiliency of the elements urging them together.

As the pin 88 and box 90 are threaded together, the coils 96 and 110 are automatically mutually axially aligned and displaced a short distance, and the housing members provided by the respective inserts 92 and 106 and pipe member walls are closed together to encircle the two coils and to provide a toroidal electrically conducting path about the coils. Edges of the plug 120 and receptacle 122 may be tapered to facilitate closing of the housing connection. A varying electromagnetic field generated about one or the other of the coils 96 or 110, produced by a varying electric current impressed on the coil, generates a varying electric current flowing in loop fashion through the walls of the inserts 92 and 106 and the walls of the pin 88 and box 90, with the current passing through the physical contact between the plug 120 and the receptacle 122. Electrical coupling between the cables 102 and 116 is thus automatically established as the corresponding pipe members are joined, and is readily broken as the pipe members are separated.

An electrical connector comprising a generally annular female receptacle is shown in part generally at 124 in FIG. 7, and a complementary electrical connector comprising a generally annular male plug is shown in part generally at 126 in FIG. 8. The female electrical connector 124 of FIG. 7 includes an elongate, generally cylindrical body 128 of electrically conducting material defining a longitudinal central passage 130. An annular trough 132 extends longitudinally into the body 128 from one end. An insulated toroidal core-wound coil 134 resides in electrically-insulating potting material 136 at the closed end of the trough 132. An annular layer of resilient electrically insulating material, such as rubber, 138 covers the potting material 136 in the trough 132. A longitudinal passage 140 through the body 128 and the potting material 136 communicates with the coil 134 to accommodate electrical leads extending from the coil to a cable or other conductor (not shown). The trough 132 and the coil 134 in the trough are concentric with the common longitudinal axis of the body 128 and the passage 130.

The male electrical connector 126 of FIG. 8 comprises a generally cylindrical body 142 of electrically conducting material defining a longitudinal central passage 144. A generally annular trough 146 extends longitudinally into the body 142. An insulated toroidal core-wound coil 148 resides at the end of the trough 146 and is covered by an annular layer of electrically insulating potting material 150. A passage 152 extends longitudinally through the body 142 to communicate with the coil 148 and accommodate electrical leads from the coil to a cable or other conductor (not shown). The trough 146 and the coil 148 are concentric with the common longitudinal axis of the body 142 and the passage 144.

The body 142 ends in a collet assembly shown generally at 154, including an annular array of inner collet arms 156 generally circumscribed by an annular array of outer collet arms 158. The trough 146 continues longitudinally through the arrays of collet arms 156 and 158, which may be provided in pairs so that each inner collet arm 156 is aligned circumferentially with a corresponding outer collet arm 158. An annular sleeve of resilient electrically insulating material, such as rubber, 160 fills the trough 146 beyond the potting material 150 and including the annular region between the inner and outer collet arms 156 and 158, respectively. Inner and outer rings 162 and 164, respectively, of resilient electrically insulating material, such as rubber, shroud the base of the collet assembly 154 as shown.

The body 142 features an upset flange 166, separated from the elongate shank of the body by a frustoconical surface 168 for a purpose discussed hereinafter.

The collet assembly 154, serving as a plug, may be received by the trough 132 of the female connector 124, serving as a receptacle, as indicated by the broken lines connecting FIGS. 7 and 8. The inner collet arms 156 feature tapered contact surfaces 170; the outer collet arms 158 include tapered contact surfaces 172. The tapering of the surfaces 170 and 172 combines with tapered annular surfaces 174 defining the mouth of the trough 132 of the female connector 124 to faciliate the closing of the two connectors. The collet arms 156 and 158 are sufficiently resilient to be urged radially against the sleeve 160 by the walls defining the trough 132, with the relatively firm friction fit between the contact surfaces 170 and 172 of the collet assembly 154 and the interior surfaces of the trough 132 insuring electrical contact therebetween. The firm fit of the collet assembly 154 within the trough 132 also serves to releasably latch the electrical connectors 124 and 126 together. One or more relief passages 176 penetrates the resilient ring 138 and the interior wall of the body 128, communicating between the interior of the trough 132 and the inner passage 130, to prevent pressure or vacuum locks as the collet assembly 154 is received within the trough 132 or withdrawn therefrom in making up or breaking the connection between the two connectors 124 and 126.

The complementary electrical connectors 124 and 126 are shown in FIG. 9 mounted within the threaded pin end of a pipe member 178 and within the threaded box end of a second pipe member 180, respectively. The body 128 of the female connector 124 extends along the interior passage 182 of the pipe member 178 and features, toward the end opposite the trough 132, an inwardly-tapered threaded portion 184. The outer surface of the body 128 is broken by a generally annular recess 186 which, in part, axially overlies the tapered threads 184. The presence of the recess 186 defines a collar 188 at the end of the body 128. One or more radial slots 189 extends longitudinally along the body 128 through the collar 188 and the profile 186. The narrowing of the wall of the body 128 at the recess 186 together with the slot 189 provides a degree of resiliency of the body to accommodate expansion and retraction of the split collar 188.

A threaded locking ring 190, featuring axially-extending internal splines 192 for a purpose described hereinafter, is received in threaded engagement by the tapered threads 184. The ring 190 is externally threaded and tapered generally to complement the tapered threads 184 of the body 128. As the ring 190 is advanced along the tapered threads 184, the expandable collar 188 is forced radially outwardly, into gripping and anchoring engagement with the interior surface defining the pipe member passage 182, flexing the resilient portion of the body 128 at the recess 186 and anchoring the electrical connector 124 to the pipe member 178.

The male electrical connector 126 extends longitudinally along the internal passage 194 of the pipe member 180, and also features a tapered, threaded portion 196 at the end of the body 142. A generally annular recess 198 breaking the outer surface of the body 142 defines a collar 200 at the end of the body. One or more radial slots 201 extends longitudinally along the body 142 through the collar 200 and the recess 198. The narrowing of the wall of the body 142 at the recess 198 combines with the slot 201 to provide a degree of resiliency of the body to accommodate expansion and retraction of the split collar 200. A threaded locking ring 202, featuring longitudinally extending internal splines 204, is received in threaded engagement by the tapered threads 196. The ring 202 is externally threaded and tapered generally to complement the tapered threads 196 of the body 142. As the locking ring 202 advances along the threads, the expandable collar 200 is forced radially outwardly into gripping and anchoring engagement with the internal surface defining the passage 194. The engagement connector 126 may thus be anchored to the pipe member 180 by use of the locking ring 202.

The electrical connectors 124 and 126 are positioned within the complementary ends of the pipe members 178 and 180, respectively, so that, as the joint between the pipe members is made up by threading as illustrated in FIG. 9, the electrical connectors are automatically closed to establish a current coupled transformer including the toroidal coils 134 and 148. With its frustoconical surface 168 abutting a complementary frustoconical surface 206 of the pipe member 180, the male electrical connector 126 is positioned so that the collet assembly 154 extends axially to be received within the trough 132 of the female electrical connector 124, which is positioned so that the ends of the walls of the body 128 defining the trough 132 are generally longitudinally aligned with the end of the pin end of the pipe member 178.

As the joint between the pipe members 178 and 180 is made up, and the collet asembly 154 advances along the trough 132, the resilient components 138 and 160–164 appropriately deform to accommodate the proximity of the bodies 128 and 142 as well as the friction fit latching contact between the collet assembly 154 and interior of the walls defining the trough 132. The latching of the electrical connection members 124 and 126 in this manner is released as the joint between the pipe members 178 and 180 is unthreaded, thereby also breaking the coupling between the coils 134 and 148.

The body 128 of the female electrical connector 124 features a spiral groove 208 about the outer surface of the body. The groove 208 communicates with the longitudinal passage 140 and, at the opposite end of the groove, communicates with a longitudinal groove 210 extending along the outer surface of the body 128 through the collar 188.

An electrically conducting cable segment 212 extends along the interior passage 182 of the pipe member 178 and lies within the grooves 210 and 208. One or more retainer plates 214, in the form of a strip, overlies the cable turns within the groove 208 and is held to the body 128 by screws 216 to anchor the cable to the electrical connector 124. The electrical leads from the cable pass along the passage 140 to the toroidal coil 134.

A spiral groove 218 breaks the surface of the body 142 of the second electrical connector 126 and communicates with an elongate, annular recess 220 in the outer surface of the body. A second spiral groove 222 communicates with the recess 220 and a longitudinally-extending groove 224 passing through the collar 200. An electrically conducting cable segment 226 extends along the interior passage 194 of the tubular member 180, and is received within the grooves 218–224. Electrical leads from the cable 226 end in the toroidal coil 148, passing along the passage 152 which also communicates with the groove 218. One or more retainer plates or strips 228 are held to the body 142 by screws 230, overlying the cable 226 in the grooves and recesses 218–222 to anchor the cable to the electrical connector 126.

The cable 226 is wrapped about the connector body 142 within the recess 220 in the manner of a double, or closed, loop for the purpose of storing slack cable to maintain the cable segment extending along the pipe member passage 194 relatively taut. The cable attachment to the electrical connector 126, as well as the manner of mounting a cable segment within a pipe member and ending in electrical connectors may be appreciated by reference to FIGS. 10 and 11.

Figure 10:
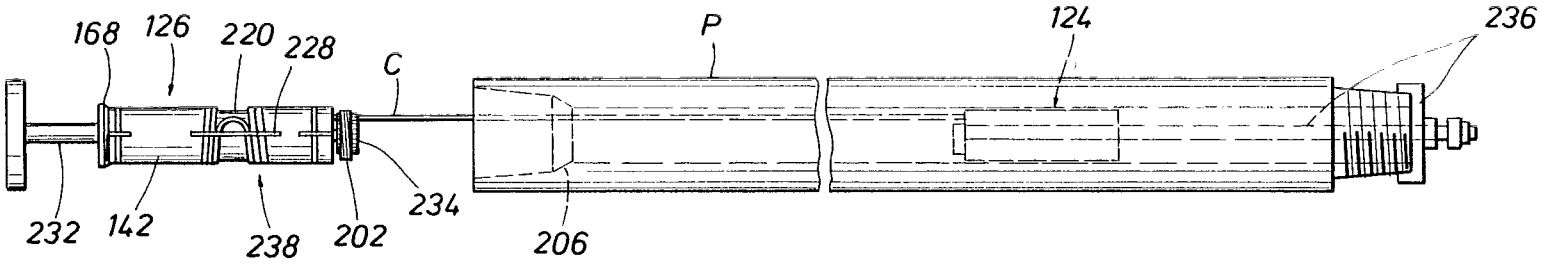
FIG. 10 is a side elevation of a pipe member, and a cable segment with male and female transformer connectors positioned for installation within the pipe member by means of an insertion tool.

In FIG. 10 a cable segment C is attached at one end to a male electrical connector 126 and at the other end to a female electrical connector 124, which is shown positioned within a pipe member P. A wrench 232 extends along the interior of the body 142 of the connector 126, and ends in a spline head 234 carrying the locking ring 202. An insertion tool 236 is positioned at the pin end of the pipe member P, and extends along the interior of the pipe member to the female electrical connector 124. Details of the construction and operation of the insertion tool 236 are described hereinafter.

The length of the pipe member P from the end of the pin to the frustoconical surface 206, combined generally with the lengths of the connectors 124 and 126, determines the distance the cable segment C must be extended along the interior of the pipe member with the electrical connectors anchored in place (FIG. 9). The additional length of cable C available after the cable segment has been anchored to the electrical connectors 124 and 126 by means of wrapping in the respective spiral grooves is stored by a loop of the cable segment being wrapped within the recess 220 of the body 142. By looping the cable segment within the recess 220 in this fashion, as much surplus cable segment may be conveniently stored as necessary to insure relative tautness of the cable segment along the interior of the pipe member P with the connectors 124 and 126 anchored in place.

Figure 11:
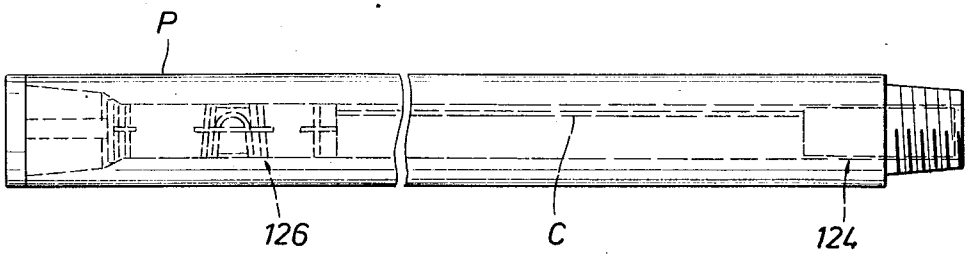
FIG. 11 is a view similar to FIG. 10, but showing the cable segment and connectors anchored in place within the pipe.

As discussed more fully hereinafter, the insertion tool 236 is used to position the female electrical connector 124 at a location within the pipe member P with the cable segment C anchored to the connector 124. The cable segment C is extended through the pipe member P and anchored to the male connector 126 in the first spiral groove 218 (FIG. 9). The male electrical connector 126 is then located a distance beyond the box end of the pipe member P equal to the displacement of the electrical connector 124 from the pin end of the pipe member. With the cable C wrapped about the second spiral groove 222 (FIG. 9), the slack cable is wrapped in the recess 220 and anchored by a retainer 228 as indicated at 238. With the cable C fully anchored to the connector 126 by retainer strips 228, the insertion tool 236 is used to draw the electrical connector 124 into position at the pin end of the pipe member P. The cable segment C pulls the male electrical connector 126 into position at the box end of the pipe member, with the complementary frustoconical surfaces 168 and 206 mutually abutting to delimit the position of the connector 126 within the pipe member P. The wrench 232 is maneuvered to threadedly engage the locking ring 202 with the tapered threads 196 (FIG. 9), expanding the collar 200 to lock the male electrical connector 126 in position at the box end of the pipe member P, as shown in FIG. 11. The insertion tool 236 is also operated to similarly advance the locking ring 190 along the tapered threads 184 (FIG. 9), expanding the collar 188 to lock the female electrical connector 124 in position within the pipe member P as indicated in FIG. 11.

Figure 12:
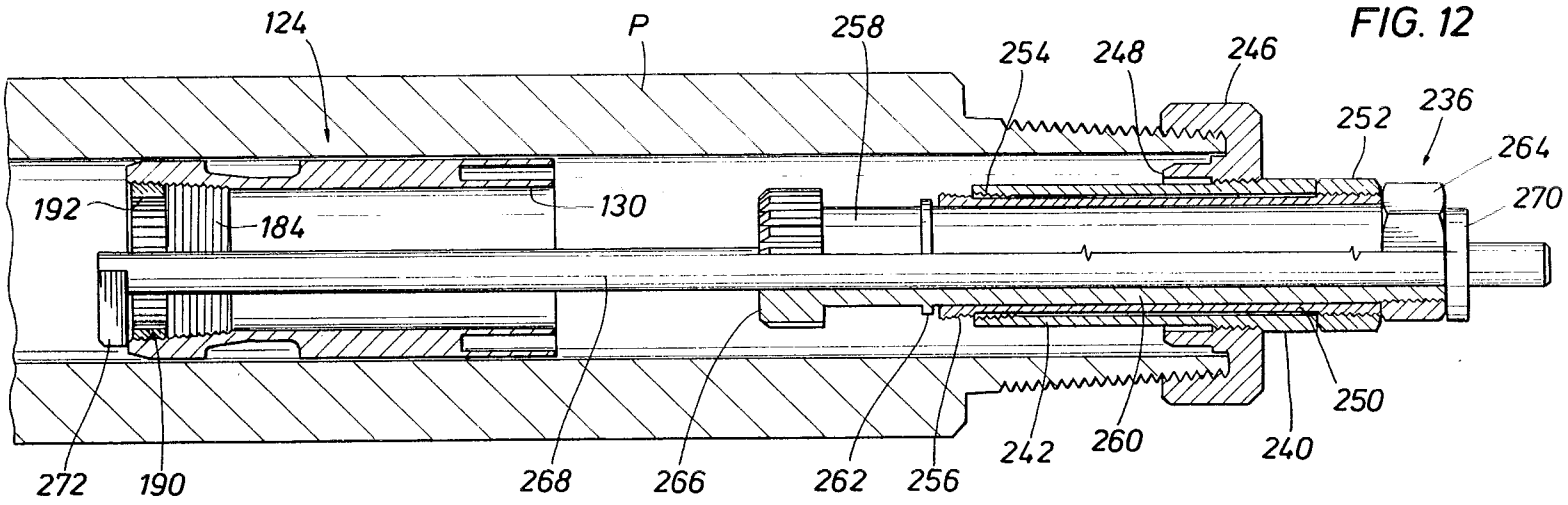
FIG. 12 is en elevation in partial section showing a female transformer cable connector located within the threaded box end of a pipe member, with an insertion tool in a first configuration for installing the cable connector within the pipe member.

In FIG. 12 the insertion tool 236 and the female electrical connector 124 are shown in the configuration of FIG. 10 with the cable segment C and some details of the electrical connector deleted for purposes of clarity. The insertion tool 236 includes a generally cylindrical housing 240, including an elongate tubular shank 242. A nut 246 with an internal annular spacer ring 248 having a tapered edge is carried by the housing 240 by means of threads. The nut 246 is threaded to the pin end of the pipe member P, and serves to position the housing 240 extending within the pipe. An elongate sleeve 250, carrying a nut 252, passes through the shank 242. The end of the shank 242 within the pipe member P features inwardly-tapered, internal threads 254. The end of the sleeve 250 opposite the nut 252 features outwardly-tapered threads 256 generally complementary to the threads 254 of the shank 242. With the sleeve 250 positioned within the housing 240 so that the nut 252 abuts the end of the housing, the threads 254 and 256 are mutually separated as illustrated.

A wrench 258 includes an elongate tubular shank 260 positioned within the sleeve 250. An annular stop 262 circumscribes the shank 260 and limits the movement of the wrench 258 out of the sleeve 250 to the right, as viewed in FIG. 12. A nut 264 is threaded to the outer end of the shank 260, and provides a second stop for abutting against the sleeve 250 to limit movement of the wrench 258 through the sleeve to the left as shown. The opposite, inward end of the wrench 258 includes a spline head 266.

A positioning rod 268 passes through the wrench 258 as well as the electrical connector 124. An annular stop 270 carried toward the outer end of the rod 268 may abut the nut 264 of the wrench 258 to limit movement of the positioning rod within the pipe member P. The opposite, inward end of the positioning rod 268 carries a radially extending L, or hook, 272. During assembly, the hook, 272 may pass through the central passage 130 of the connector 124 by tilting of the connector relative to the positioning rod 268 if necessary. However, with the connector 124 and the insertion tool 236 mounted in the pipe member P as illustrated in FIG. 12, the positioning rod 268 may be maintained axially parallel with the connector 124, and the hook 272 engages the end of the connector to limit movement thereof relative to the positioning rod.

Figure 13:
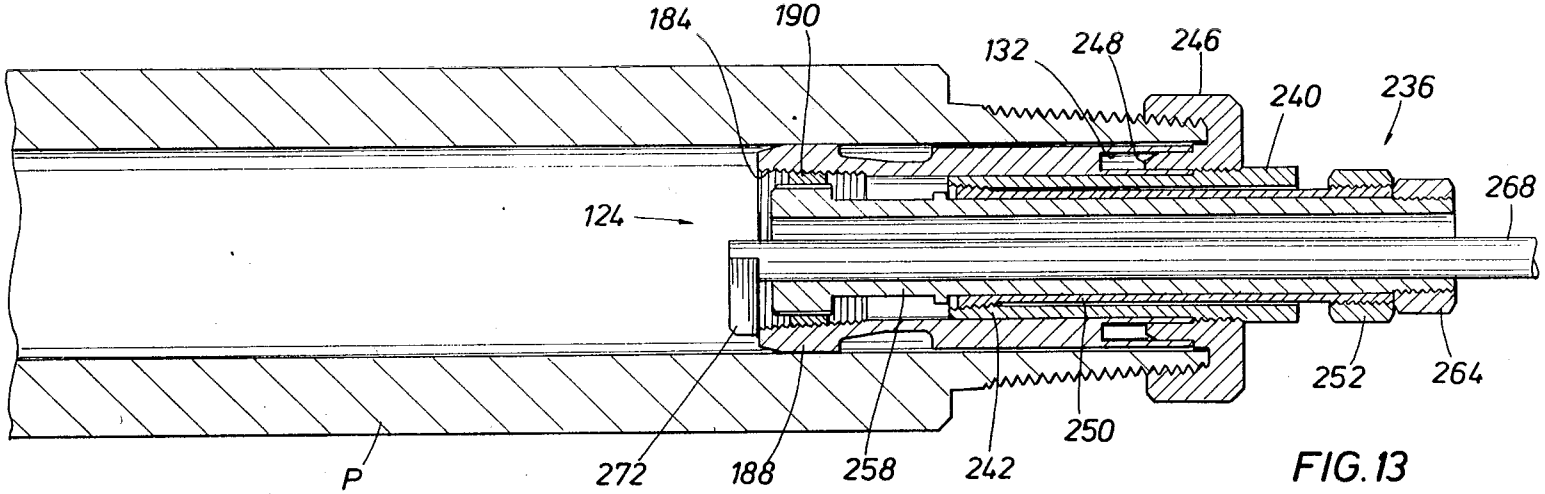
FIG. 13 is a view similar to FIG. 12, but with the insertion tool in a second configuration and with the cable connector anchored within the pipe member.

To mount the cable C and connectors 124 and 126 in a pipe member P, the cable is anchored to the female connector 124 as described hereinbefore, which is then placed inside the pipe member with the positioning rod extending through the connector 124. With the insertion tool 236 mounted on the pipe member P by the nut 246, and the sleeve 250 advanced into the pipe member P so that the nut 252 abuts the end of the housing 240, and with the wrench 258 and the positioning rod 268 located so that the wrench nut 264 abuts the sleeve 250 and the stop 270 abuts the nut 264, the cable segment C may be pulled through the pipe member P (to the left as viewed in FIG. 10) to draw the connector 124 into the pipe member and against the hook 272, as FIGS. 10 and 12 illustrate. With the cable C anchored to the male electrical connector 126 and the slack cable fastened about the connector 126 at 238 as described hereinbefore (FIG. 10), the positioning rod 268 may be drawn out of the pipe member P to the right as viewed in FIG. 12, pulling the female electrical connector 124 toward the nut 246 at the pin end of the pipe member, and drawing the male electrical connector 126 into the box end of the pipe member by means of the cable. The movement of the positioning rod 268 continues until the connector 124 is seated against the nut 246, with the spacer ring 248 received within the trough 132, centering the connector within the pipe member P (FIG. 13). As the connector 124 is thus drawn against the nut 246, the locking nut 190 engages the spline head 266 by the meshing of the locking ring splines 192 with the splines of the spline head. The wrench 258 may be rotated by rotation of the nut 264 to align the spline head 266 with the locking ring 190 to accommodate the meshing of these latter components.

With the housing nut 246 held against rotation, the sleeve 250 is moved along the shank 242 and rotated by means of the nut 252 to thread the sleeve to the shank. Advancement of the tapered sleeve threads 256 along the tapered shank threads 254 expands the end of the shank about the threads 254 and wedges it into gripping and anchoring engagement with the interior surface of the electrical connector 124. One or more elongate slots (not shown) may be provided in the shank 242 at the threads 254 to render the shank so expandable at that location.

With the housing 240 anchored to the connector 124 by means of the expanded shank 242, the wrench nut 264 is rotated to turn the wrench 258 and apply torque to the locking ring 190 by means of the spline head 266 meshed with the splines 192 of the locking ring. Rotation of the locking ring 190 by means of the wrench 258 advances the locking ring along the tapered threads 184 of the expandable collar 188, thereby forcing the collar to expand to lock the connector 124 to the pipe member P as illustrated in FIG. 13.

With the connector 124 anchored in position, the sleeve nut 252 may be rotated to unthread the sleeve 250 from the shank 242, releasing the gripping engagement between the housing 240 and the connector. The housing nut 246 may then be removed from the threaded pin end of the pipe member P, and the housing 240, sleeve 250, and wrench 258 withdrawn from the connector 124, allowing the positioning rod 268 to be tilted for removal of the rod and hook 272 from the connector as well.

Set screws or keys (not shown), for example, or other appropriate means may be used to lock the nut 246 to the housing 240, the nut 252 to the sleeve 250, and the nut 264 to the wrench shank 260 so that each of these nuts may be used to selectively hold, fix or move the respective tubular element rotationally.

With the female connector 124 anchored in place in the pipe member P as described, the tightly stretched cable segment C holds the male connector 126 in place with its frustoconical surface 168 seated against the frustoconical surface 206 of the pipe member while the wrench 232 is used to anchor the male connector to the pipe member P. The wrench 232 may be manipulated to enage the locking ring 202 with the tapered threads 196 at the end of the connector body 142 (FIG. 9), and then rotated to apply torque to the locking ring by means of the spline head 234. Such rotation advances the locking ring 202 along the connector threads 196 to expand the collar 200 and wedge it into gripping and anchoring engagement with the interior surface of the pipe member P. Frictional forces between the frustoconical surfaces 168 and 206 of the connector 126 and the pipe member P, respectively, will hold the connector body 142 against rotational movement relative to the pipe member as the wrench 232 is used to thread the locking ring 202 along the tapered threads 196. With the locking ring 202 tightened, the wrench 232 may be manipulated to disengage the spline head 234 from the splines 204 of the locking ring, and may be withdrawn from the connector 126.

Two or more pipe members P, each with a cable segment C extended internally between male and female electrical connectors 124 and 126, respectively, may be made up into a pipe string. At each pipe joint, complementary electrical connectors combine to form transformer couplers to current-couple the cable segments of the joined pipe members. Thus, a signal transmission path, including a sequence of current-coupled cable segments as indicated schematically in FIG. 3, arrayed within a pipe string, is provided.

To remove a cable segment and attached connectors from a pipe member P the mounting procedures described hereinbefore may be generally reversed. The wrench 232 may be inserted within the male connector 126 and the spline head 234 used to loosen the locking ring 202 from the tapered threads 196, thereby allowing the collar 200 to relax and release the connector 126 from anchoring engagement with the interior surface of the pipe member P. The insertion tool 236 may be installed within the female connector 124, and the housing shank 242 expanded into gripping engagement with the connector body 128 by the sleeve 250 as shown in FIG. 13. The wrench 258 is then operated to loosen the locking ring 190 from the tapered threads 184, thereby allowing the collar 188 to relax and release the connector 124 from anchoring engagement with the interior surface of the pipe member P. Thereafter, the female connector 124 may be removed by the insertion tool 236, pulling the cable segment C and the male connector 126 from the pipe member P as well.

The present invention provides an efficient and quick connect/disconnect coupling for transmission of electrical signals along a sequence of cable segments, for example. The coupling is relatively inexpensive, avoiding the necessity of expensive special or modified pipe members. Further, there are no significant requirements for low tolerance in the quality of the contacts employed with the present invention to achieve current coupling. The use of special greases to prevent electrical leakage at the joints is not critical.

The coupling of the present invention may be utilized, for example, to convert cable segments for the transmission of electronic signals in either or both directions between the surface and downhole well locations. Additionally, such signal transmissions may be effected at relatively high rates of data bit transfer. Further, the present coupling exhibits relatively low signal attenuation. Where a large number of cable segments are coupled in sequence according to the present invention so that signal loss may tend to become a factor, one or more repeaters or boosters may be provided at appropriate intervals along the cable sequence to achieve the required compensation for losses.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. An electrical connector means, comprising:

a first connector portion including a first electrically conducting coil element partially enclosed by a first, electrical conducting means and defining a first axially open passageway;

a second connector portion including a second electrically conducting coil element partially enclosed by a second, electrical conducting means and defining a second axially open passageway; and conductive coupling means for current coupling said first and second coil elements defined by connection of said first and second electrical conducting means for enclosing said first and second coil elements in an electrical conducting path and aligning said first and second passageways, wherein said first and second coil elements are mutually electrically isolated one from the other within said conductive coupling means.

2. Electrical connector means as defined in claim 1 wherein said electrical conducting means comprises a first housing member generally partially enclosing said first coil element, and a second housing member generally partially enclosing said second coil element, and wherein, when said first and second coil elements are so positioned generally mutually parallel, said first and second housing members are in mutual electrical contact to provide said electrical conducting path.

3. Electrical connector means as defined in claim 2 wherein each of said first and second coil elements comprises a toroidal coil.

4. Electrical connector means as defined in claim 1 wherein each of said first and second coil elements comprises a toroidal coil.

5. An apparatus capable of providing electrical connection between electrical conductors, comprising:

a first toroidal coil for connection to a first conductor, and a second toroidal coil for connection to a second conductor, said first and second toroidal coils mutually electrically isolated one from the other;

a first electrically conducting housing member partially enclosing said first toroidal coil and defining a first axially open passageway, said first toroidal coil being electrically insulated from said first housing member; and a second electrically conducting housing member partially enclosing said second toroidal coil and defining a second axially open passageway, said second toroidal coil being electrically insulated from said second housing member, wherein cooperation of said first and second housing members aligns said first and second passageways, forms a toroidal conducting housing enclosing said first and second toroidal coils and maintains said mutual electrical isolation between said first and second toroidal coils.

6. Apparatus as defined in claim 5 further comprising coupling means for joining said first and second housing members to so form said toroidal housing.

7. Apparatus as defined in claim 6 wherein said coupling means comprises:

a generally annular receptacle generally axially aligned with said first toroidal coil and fixed relative thereto, and having a generally annular outer wall circumscribing a generally annular inner wall; and a generally annular spring member, circumscribing a second generally annular spring member, said first and second spring members generally axially aligned with said second toroidal coil and fixed relative thereto, wherein said first and second annular spring members may be received within said annular receptacle to releasably mutually anchor said first and second housing members.

8. Apparatus as defined in claim 7 wherein, when said first and second housing members are so mutually releasably anchored by said first and second spring members received within said annular receptacle, said toroidal housing is effected, at least in part, by electrical contact between said first spring member and the outer wall of said annular receptacle, and between said second spring member and the inner wall of said annular receptacle.

9. Apparatus as defined in claim 7 wherein at least one of said first and second spring members comprises collet means.

10. Apparatus as defined in claim 6 wherein said coupling means comprises resilient means for releasably latching said first and second housing members together.

11. A tubular assembly, comprising:

an elongate, tubular shank including a longitudinal passage therethrough;

electrical conductor means extending generally along at least a portion of the interior of said passage;

first electrical terminal means positioned toward a first end of said shank and including a first toroidal coil electrically connected to said conductor means and generally axially aligned with the longitudinal axis of said shank and a first electrically conducting housing member generally partially enclosing said first coil; and second electrical terminal means positioned toward the opposite, second end of said shank and including a second toroidal coil electrically connected to said conductor means and generally axially aligned with the longitudinal axis of said shank and a second electrically conducting housing member generally partially enclosing said second coil, whereby each of said housing members may electrically contact a complementary housing member at least partially enclosing a coil as part of a second tubular assembly shank generally aligned with respect to an end of said first tubular assembly to provide an electrical conducting path enclosing said first toroidal coil of said first tubular assembly and said second toroidal coil of said second tubular assembly.

12. A tubular assembly as defined in claim 11 wherein one of said first or second ends of said shank is equipped with a threaded pin, and the other of said first or second ends of said shank is equipped with a threaded box whereby said shank may be engaged with complementary threaded components.

13. A tubular assembly as defined in claim 11 wherein:

said first electrically conducting housing member is generally annular and is aligned with, and at least partially enclosing, said first toroidal coil, with an annular opening oriented generally outwardly from said shank; and said second electrically conducting housing member is generally annular and is aligned with, and at least partially enclosing, said second toroidal coil, with an annular opening oriented generally outwardly from said shank.

14. A tubular assembly as defined in claim 13 wherein one of said first or second housing members of said tubular assembly shank comprises a generally annular female receptacle, and the other of said first or second housing members of said tubular assembly shank comprises a complementary, generally annular male plug whereby complementary housing members of connected tubular assembly shanks may combine, with said male plug received within said female receptacle, to so electrically connect said housing members and enclose corresponding paired toroidal coils.

15. A tubular assembly as defined in claim 14 wherein one of said first or second ends of said shank is equipped with a threaded pin, and the other of said first or second ends of said shank is equipped with a threaded box whereby a plurality of said shanks may be threadedly engaged, with the electrical conductors extending through the respective shank passages electrically coupled by means of the paired toroidal coils enclosed by the corresponding connected housing members.

16. A tubular assembly as defined in claim 11 wherein said first terminal means further comprises female receptacle means for effecting mechanical and electrical connection to complementary terminal means.

17. A tubular assembly as defined in claim 11 wherein said second terminal means further comprises male plug means for effecting electrical and mechanical connection to complementary terminal means.

18. A tubular assembly as defined in claim 11 wherein each of said first and second terminal means is located within the wall of said shank.

19. A tubular assembly as defined in claim 11 wherein each of said first and second terminal means is located within said passage of said shank.

20. A tubular assembly comprising a plurality of tubular members arranged in sequence and generally aligned, with the ends of adjacent members joined, wherein:

each of said tubular members includes electrical conducting means extending along said tubular member and connected to terminal means at each end of said tubular member;

each of said terminal means comprises a toroidal coil with the cylindrical axis of said coil generally aligned with the longitudinal axis of the respective tubular member;

each of said terminal means further comprises a generally annular housing member of electrically conducting material at least partially enclosing the corresponding toroidal coil; and at each junction between tubular members the toroidal coil at the corresponding end of one tubular member is generally parallel and axially displaced from the toroidal coil at the corresponding end of the other tubular member, and the corresponding housing member of one tubular member is electrically connected to the corresponding housing member of the other tubular member so that the paired toroidal coils are enclosed within conducting material providing a generally toroidal electric current conducting path.

21. A tubular assembly as defined in claim 20 wherein said terminal means of each tubular member are generally located within the longitudinal passage of said tubular member.

22. A tubular assembly as defined in claim 20 wherein each tubular member is equipped with collar means at each end of said tubular member, and said terminal means of said tubular member are located generally within said corresponding collar means.

23. A tubular asSembly as defined in claim 20 wherein the electrical connection between conducting means of adjacent tubular members, provided by the said juxtaposition of paired toroidal coils and the electrical connection between corresponding housing members, is effected automatically by the joining of said two tubular members.

24. A method of assembling a pipe string including electrical cable means extending along at least a portion of the length of said pipe string, comprising the following steps:

providing a plurality of pipe segments with each pipe segment containing a cable means segment connected to toroidal coil terminals at each end of the pipe segment, and wherein the toroidal coils are at least partially confined by generally annular housing members of electrically conducting material; and mechanically connecting together complementary ends of said pipe segments to form said pipe string with a generally continuous internal longitudinal passage therethrough, positioning toroidal coils at adajcent ends of connected pipe segments mutually generally parallel, and electrically connecting the corresponding housing members about said paired toroidal coils to provide a generally toroidal electrically conducting path about said paired toroidal coils, whereby said cable means segments are interconnected by current coupling at each junction between pipe segments in said pipe string.

* * * * *